US012654830B2

(12) United States Patent
Schmidt

(10) Patent No.: US 12,654,830 B2
(45) Date of Patent: Jun. 16, 2026

(54) WATERCRAFT AND METHOD OF PROPULSION OF A WATERCRAFT

(71) Applicant: Collin Ashley Schmidt, St. Petersburg, FL (US)

(72) Inventor: Collin Ashley Schmidt, St. Petersburg, FL (US)

( * ) Notice: Subject to any disclaimer, the term of this patent is extended or adjusted under 35 U.S.C. 154(b) by 569 days.

(21) Appl. No.: 18/124,023

(22) Filed: Mar. 21, 2023

(65) Prior Publication Data

US 2023/0219669 A1 Jul. 13, 2023

Related U.S. Application Data

(63) Continuation-in-part of application No. 17/193,068, filed on Mar. 5, 2021, now abandoned.

(60) Provisional application No. 62/987,438, filed on Mar. 10, 2020.

(51) Int. Cl.

| | |
|---|---|
| ***B63H 16/20*** | (2006.01) |
| ***B63H 11/113*** | (2006.01) |
| ***B63H 25/02*** | (2006.01) |
| ***B63H 25/38*** | (2006.01) |
| ***B63H 25/46*** | (2006.01) |

(52) U.S. Cl.

CPC ..... *B63H 16/20* (2013.01); *B63H 11/113* (2013.01); *B63H 25/02* (2013.01); *B63H 25/38* (2013.01); *B63H 25/46* (2013.01); *B63H 2025/022* (2013.01); *B63H 2025/026* (2013.01)

(58) Field of Classification Search

CPC ..... B63H 11/113; B63H 25/02; B63H 25/38; B63H 25/46; B63H 2025/022; B63H 2025/026; B63H 34/10; B63H 11/08; B63H 16/14; B63H 16/20; B63H 2016/202; B63B 16/00; B63B 16/12; B63B 11/00; B63B 11/02; B63B 11/04; B63B 11/06; B63J 2003/003; B63J 2003/005; Y02T 70/00

USPC ..... 440/6, 7, 21, 26, 27, 29, 30

See application file for complete search history.

(56) References Cited

U.S. PATENT DOCUMENTS

| | | | | |
|---|---|---|---|---|
| 3,948,206 A * | 4/1976 | Tyler | B63B 1/18 | 440/88 P |
| 5,133,777 A * | 7/1992 | Arbogast | A61F 2/76 | 623/901 |
| 5,184,564 A * | 2/1993 | Robbins | B63B 7/082 | 114/352 |
| 5,520,133 A * | 5/1996 | Wiegert | B63B 34/10 | 440/38 |
| 6,422,168 B1 * | 7/2002 | Kobayashi | B63B 1/20 | 114/291 |
| 6,675,730 B2 * | 1/2004 | Simard | B63B 34/10 | 440/43 |

(Continued)

FOREIGN PATENT DOCUMENTS

WO WO-2005108201 A1 * 11/2005 ..... B63H 16/14

*Primary Examiner* — Daniel V Venne
(74) *Attorney, Agent, or Firm* — Pierson IP, PLLC

(57) ABSTRACT

A watercraft having a body with an opening for a user, a seat, at least one drive mechanism placed at least partially within the opening; an intake configured to allow a flow of water from a body of water surrounding the watercraft; a pump configured receive the flow of water and accelerate the flow of water, and a user controlled discharge configured to receive the flow of accelerated water from the pump and discharge the accelerated water to the water surrounding the watercraft such that the watercraft moves in a direction chosen by the user.

1 Claim, 4 Drawing Sheets

(56) References Cited

U.S. PATENT DOCUMENTS

| | | | | |
|---|---|---|---|---|
| 7,166,003 | B2 * | 1/2007 | Motose | F02D 11/105 440/87 |
| 7,201,620 | B2 * | 4/2007 | Kinoshita | B63H 21/21 440/87 |
| 7,422,495 | B2 * | 9/2008 | Kinoshita | B63H 21/213 440/3 |
| 7,513,807 | B2 * | 4/2009 | Kinoshita | B63H 21/21 440/2 |
| 7,549,900 | B2 * | 6/2009 | Kinoshita | B63B 34/10 440/1 |
| 7,856,937 | B2 * | 12/2010 | Chapdelaine | B63B 43/06 114/55.51 |
| 10,011,327 | B2 * | 7/2018 | Sato | B63B 34/10 |

* cited by examiner

WATERCRAFT AND METHOD OF PROPULSION OF A WATERCRAFT

CROSS-REFERENCE TO RELATED APPLICATIONS

The present disclosure seek priority to U.S. Provisional Patent Application 62/987,438 dated Mar. 10, 2021, the entirety of which is incorporated by reference.

FIELD OF THE DISCLOSURE

Aspects of the disclosure relate to water travel and activity. More specifically, aspects of the disclosure relate to a watercraft and method of propulsion of the watercraft.

BACKGROUND

In 2018, 22.9 million people in the United States participated in water paddling sports and activities. Enthusiasm in human powered watersports is growing, despite the fact that the major engine of mechanical power on the human body (the legs) are neglected in most watercraft. Watercraft that do utilize the power of the operator's legs use an incomplete revolution, 'stepping' motion. This motion is inefficient, resulting in loss of speed and range in the performance of the watercraft. Further losses are taken in the use of oscillating fins and propellers for locomotion, which both enjoy peak efficiency only in a very narrow range of operating speed, and are subject to complex geometries and losses.

Conventional watercraft are expensive to produce and can be difficult to operate for the untrained user. Movement and storage of such watercraft are also difficult, thereby limiting the use of such craft. Moreover, in order to achieve speed, conventional watercraft use gasoline powered engines with props. While speed can be achieved through such combinations, many bodies of water have restrictions on the use of gasoline prop based watercraft, essentially making such bodies of water off limits for the recreational user. Additionally, the use of gasoline presents an environmental concern in marine environments.

There is a need to provide apparatus and methods that are easier to operate than conventional apparatus and methods.

There is a further need to provide apparatus and methods wherein watercraft may be used in all bodies of water. In addition to the aforementioned, limitations in water depth also exclude the use of certain watercraft in certain conditions. Water depth restricts the operation of many conventional craft, in transportation, and access to fishing and other aquatic activities.

There is a still further need to reduce economic costs associated with operations and apparatus described above with conventional watercraft.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, a watercraft is disclosed. The watercraft may comprise at least one body. The watercraft may also comprise a seat configured to support a user. The watercraft may also comprise at least one drive mechanism actuated in complete revolutions by the user. The watercraft may also comprise an intake configured to allow a flow of water from a body of water surrounding the watercraft. The watercraft may also comprise a pump configured to receive the flow of water and accelerate the flow of water. The watercraft may also comprise a discharge configured to receive the flow of accelerated water from the pump and discharge the accelerated water to the water surrounding the watercraft.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and are therefore not be considered limiting of its scope, for the disclosure may admit to other equally effective embodiments.

Figure 1A:
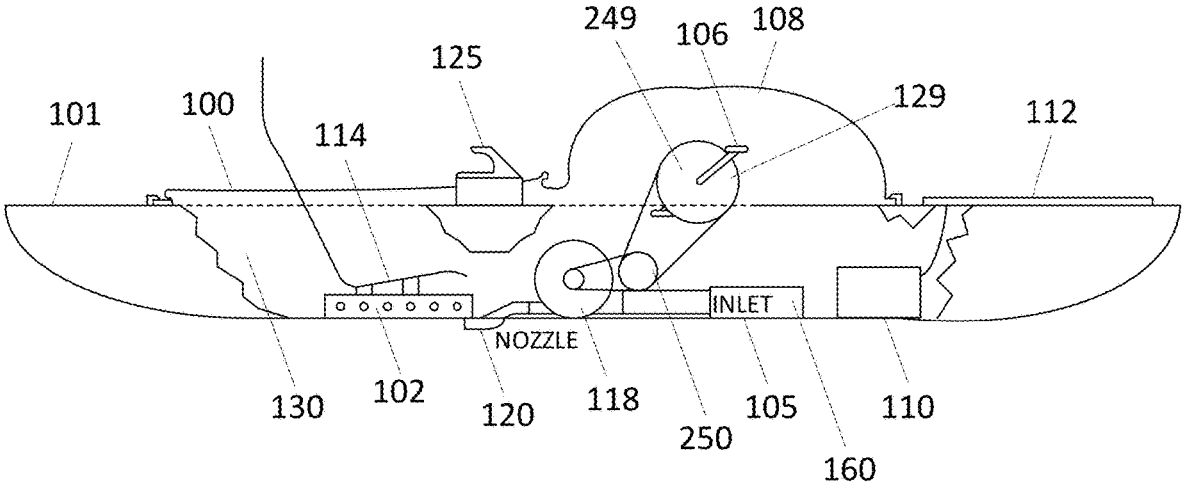
FIG. 1A and FIG. 1B are a watercraft in one aspect of the disclosure.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and shall not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Figure 1B:
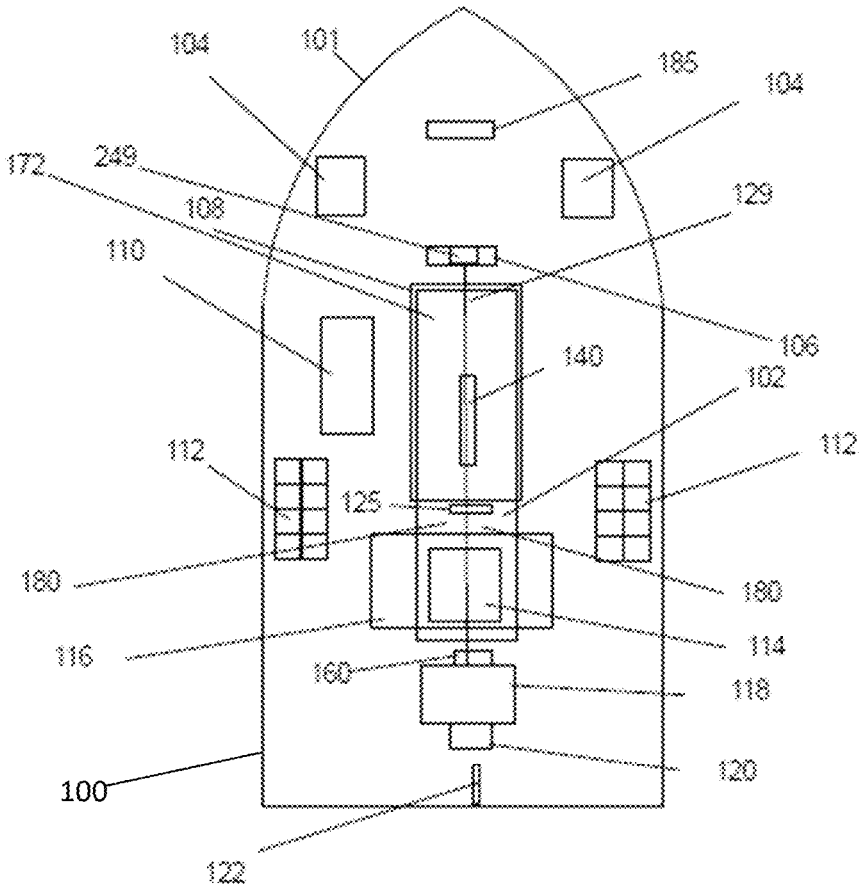

Internal details of such components, such as the internal vane structure of the pump or internal gearing of the drive mechanism, are omitted for clarity because such internal structure is not necessary for understanding the invention. A person of ordinary skill in the art would understand how such components may be implemented based on the present description. The schematic representations in the drawings are not intended to limit the scope of the disclosure or the claims, but instead illustrate the general configuration and interconnection of major elements of the system. Referring to FIG. 1A and FIG. 1B, a watercraft 100 is illustrated. The watercraft 100 is comprised of a body 101 that has an opening 102 into which a human or pilot may enter. The opening 102 allows the pilot to extend his or her legs into the body 101 that has an internal volume 130 created for housing the pilot. A set of pedals 106 are provided such that rotation of the pedals 106 allows for rotation of a pump 118. A wheel 125 may be provided such that steering is effectuated for the watercraft 100. In some embodiments, a nozzle discharge for a pump 118 may be located at a fixed location and steering effectuated through a rudder 122. The rudder 122 may be located under the body 101 to provide for lateral control of the watercraft 100. The wheel 125 may be configured such that turning of the wheel 125 may turn a discharge nozzle 120 of the pump 118. Other embodiments allow for turning of the rudder 122 or a skeg 140 located underneath the watercraft 100. In other embodiments, the wheel 125 may be replaced with a joystick that will direct the nozzle 120 of the pump 118. As previously described, the nozzle 120 may be fixed in some instances or the nozzle 120 may be directionally controlled by the pilot. The joystick may also be used to articulate the rudder in the case of a fixed discharge nozzle 120 direction. A traditional paddle may be used to steer the craft.

Figure 1C:
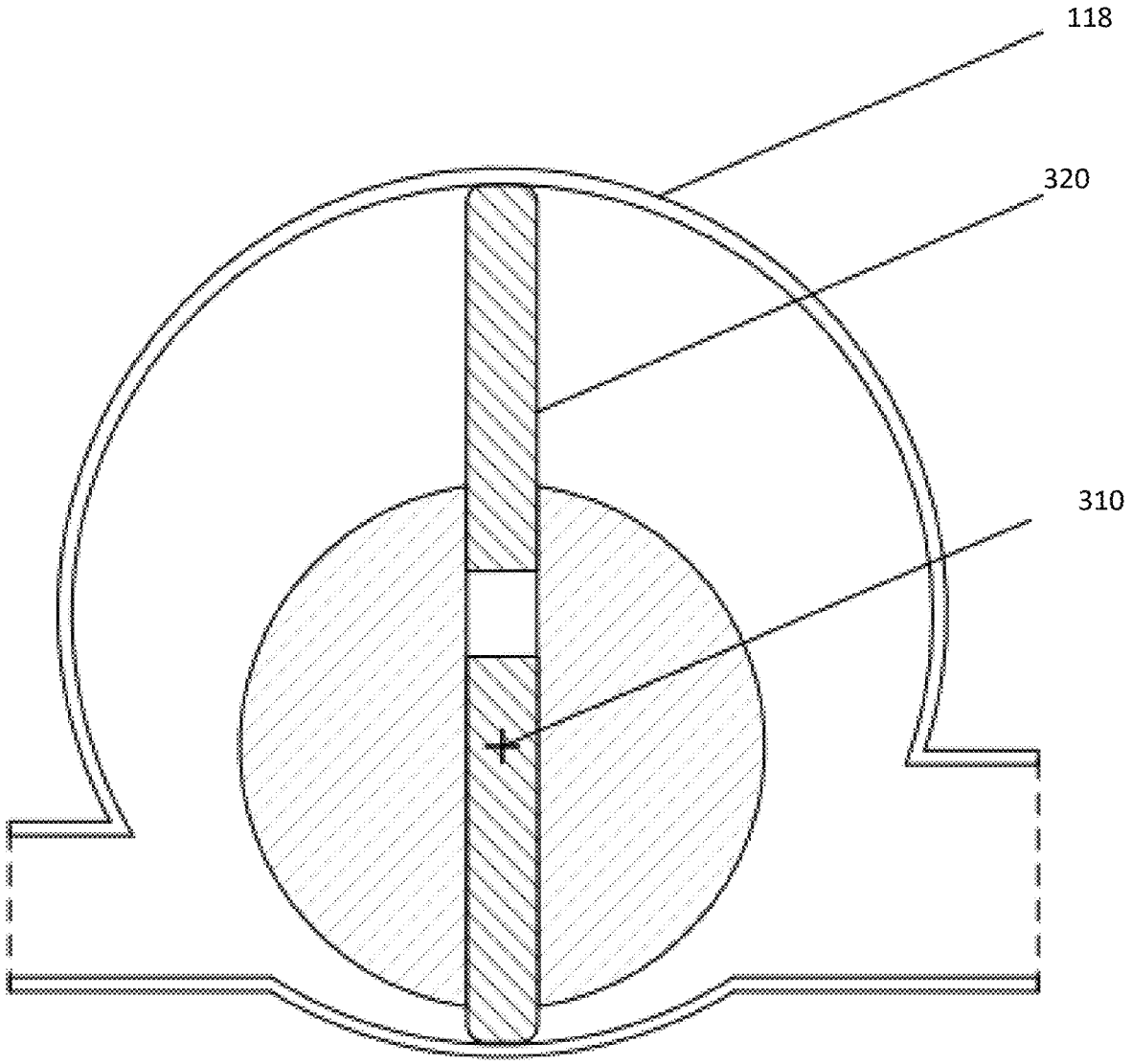
FIG. 1C depicts a cross section of a portion of the watercraft.

At the inlet 160 of the pump 118 a filtering system 105 is provided. The purpose of the filtering system 105 is to prevent debris from entering the pump 118 and clogging the internals of the pump 118 or other components of the driving mechanism for the watercraft 100. The filtering system 105 may be configured as a cartridge system where individual cartridges 104 at the front of the watercraft 100, or sides of the watercraft 100 may be removed and cleaned, as appropriate. Such cartridges 104 may be removable from the body 101, cleaned and then reused. In other embodiments, the cartridges 104 may be replaceable or cleaned in place. The use of a filtering system 105 allows for use of the watercraft 100 in water environments that have solids within them, such as grass, leaves, wood, trash, without detrimentally impacting the overall operation of the watercraft 100. In some embodiments, the filtering system 105 may have components that are made of flexible materials to prevent damage from materials impacting the watercraft 100. In the case of materials passing the filtering system 105 and entering the pump 118, a minimum distance may be created between the vanes of the pump 118 and the housing of the pump 118 to allow to these materials to not impact the vanes or prevent the pump 118 from continuing to function. In other embodiments, an internal cutting mechanism may be provided prior to the vanes of the pump 118 to cut any foreign materials prior to entry into the vanes of the pump 118. A cutter may be positioned inside the pump 118 to mechanically degrade entrained solids. The internal construction of the pump 118 may be such that a minimum clearance is maintained between confining surfaces for the passage of irreducible solids. In one embodiment, the vane pump may be constructed using vanes of different geometry. As depicted in FIG. 1C, A pair of 180 degree opposed vanes allowed to pass through the center of rotation along axis 310 perform the primary pumping, while other, captured vanes perform limited pumping and prevent the backflow of water between pump outlet and inlet over certain crank angles. In embodiments, at least one vane 320 within the pump is capable of travel through a center axis of a pump rotor. Vanes may be driven outward by springs constrained by internal rods. In one embodiment, the inlets to the pump are facing the forward to facilitate the flow of water from the intakes, which are positioned in front of the pump. The outlets of the pump may be facing forward, with hose, tube, or pipe used to deliver water to the discharge. The outlets of the pump may be facing rearward, with a change gear used to alter the rotational direction between the drive and pump.

A seat 114 is provided in one embodiment. The seat 114 may be removable from the watercraft 100 to make the watercraft 100 lighter for transport. The seat 114 may be adjustable such that a pilot may recline in a recumbent position. A head rest and arm supports may be provided. The seat 114 may have height controls as well as forward and rearward positioning capability.

A motor 185 is connected to the pump 118 in one embodiment. The motor 185 may be a direct current ("DC") motor that powers the pump 118, thereby propelling the watercraft 100. The motor 185 may be actuated through a toggle switch by the direction of the pilot. The motor 185 may be used in conjunction with pedal 106 power from the pilot for movement.

A battery 110 may be included with the watercraft to allow for storage of energy. The battery 110 may be pre-charged allowing for power to be provided to the motor 185 and pump 118 when necessary. In embodiments, the battery 110 may be a lithium ion battery, marine gel cell, a nickel cadmium unit or other appropriate battery system. An array of solar cells 112 may be located along the top of the watercraft 100 to allow for the charging of the battery 110 while inside the watercraft 100. In other embodiments, when lightness of the watercraft 100 is desired, the battery 110 may be omitted. In still further embodiments, the battery 110 may be configured to be removable from the watercraft 100.

In some embodiments, navigational signals may be placed at the prow of the watercraft 100 as well as the stern of the watercraft 100. These signals may draw power from the user or from the battery 110 on board.

In some embodiments, the pedals 106 and chain 129 may be connected to the pump 118 through a series of gearing that may be selected by the pilot. Gearing may be selected by the pilot through hand operated controls, allowing for greater or lesser rotation of speed of the pump 118. Other embodiments are possible for providing a motive force from the pedals to the motor. In one example embodiment, a toothed belt may be used instead of a chain and sprocket design.

In the case of inadvertent water entering the body, a drainage system 172 may be provided for the watercraft 100. The drainage system 172 may be a system that is selectable by the pilot such that water may accumulate in a low point within the watercraft 100. A one-way valve is then opened by the pilot allowing for a section of the water from the interior of the watercraft 100 and expelling of the water to the outside environment. In one embodiment, a one way float valve may be used with a suction occurring when the pump 118 is operating. In another embodiment, a hand valve may be used, similar to the float valve, wherein a suction occurs when the pump 118 is operating.

Other features may be provided for the watercraft 100 to allow a pilot more comfort during operation. These features include a canopy 108 that will protect the pilot from wind and splashing water during operation. In other embodiments, a sun shield may be provided such that the pilot is shielded from sunlight during operation. A feature of the canopy may be to limit the excessive taking on of water into the cockpit, thereby acting to preserve safety and performance. Other embodiments of the disclosure provide for the use of a paddle or a set of paddles wherein a pilot may use the paddles for creating a motive force for the watercraft 100. A set of paddle locks may be created on the watercraft 100 to allow for transfer of energy. Torque generated by the core strength of the pilot can be used to cancel the &de to side rocking motion that use of pedals 106 may create. The paddle can be expected to be used as the sole source of steering, and as a backup means of propulsion in an embodiment. Protrusions on the edges of the cockpit opening may be provided as a point of contact to rest the stern on the paddle on the craft, also allowing the user to exert a torque on the craft in roll via the users arms which can cancel the cyclical roll torque resulting from the foot pedal operation.

Aspects of the disclosure provide a watercraft that may be used in a variety of situations. In aspects described, a high performance, high efficiency human powered watercraft is provided with a positive displacement pump driven by the legs of a human ("pilot") being in a reclined, recumbent position. The positive displacement pump has high volumetric efficiency across a wide speed range. The full revolution of the foot pedals and support of the recumbent seat allow for optimal force production and fatigue resistance of the legs and core of the pilot.

Aspects of the disclosure provide several advantages over conventional watercraft. Aspects allow a fitness component to sailing wherein pedal rotation may be used to activate a pump for propulsion. Such actuation allows for recreational use of various bodies of water that were not previously able to be used. Aspects further provide for a cost-efficient way of introduction to boating. Conventional boats require large expenses of capital to purchase and maintain. In embodiments provided herein, boating may be performed in a relatively cost-efficient manner. Furthermore, in aspects, towing or large carrying capability for movement of the watercraft is unnecessary as the aspects disclosed provide a compact footprint. For purposes of illustration and the claims, a "drive mechanism" 250, may include the aforementioned pedals 106, sprocket 249 and chain 129. The chain 129 may be connected to the sprocket 249 and the pump 118, thereby conferring rotational energy from the sprocket to the pump 118.

Flexibility is also provided in the aspects disclosed. If a boater wishes to rest, the pump may be operated by an electric motor, thereby freeing the user from manual effort. On occasion where more propulsion is necessary that can be achievable through the use of human effort, the electric motor may assist in moving the pump through the battery system. The watercraft, therefore, can be operated in current conditions where a paddle operated unit would be impossible. Moreover, aspects of the disclosure provide for battery operation at all times, such as at dusk when sunlight is less prevalent. In hours of high sunlight, the electricity produced by the solar cells will allow for either rapid charging of the battery and/or use of the electricity for movement of the pump for propulsion. As components are modular, configurations may be used wherein a battery is omitted, to reduce overall weight of the watercraft.

Simplicity of design allows for wheel or joystick operation of the watercraft. Thus, novices may enjoy the use of the watercraft with little to no knowledge of tacking into the wind, gybe turns or other sailing techniques. Furthermore, steering directly into the wind is possible, compared to a sailing craft that must point the craft "off wind" for progression upwind.

Aspects of the design also provide for ease of maintenance wherein a removable filtration system allows the watercraft to be used in environments where debris may be found. Such debris may be river grass, floating wood, seaweed, and other debris. By allowing a removable cartridge system that is easily accessible by a user, the pump components may be kept clean from debris and in good working condition.

Figure 2:
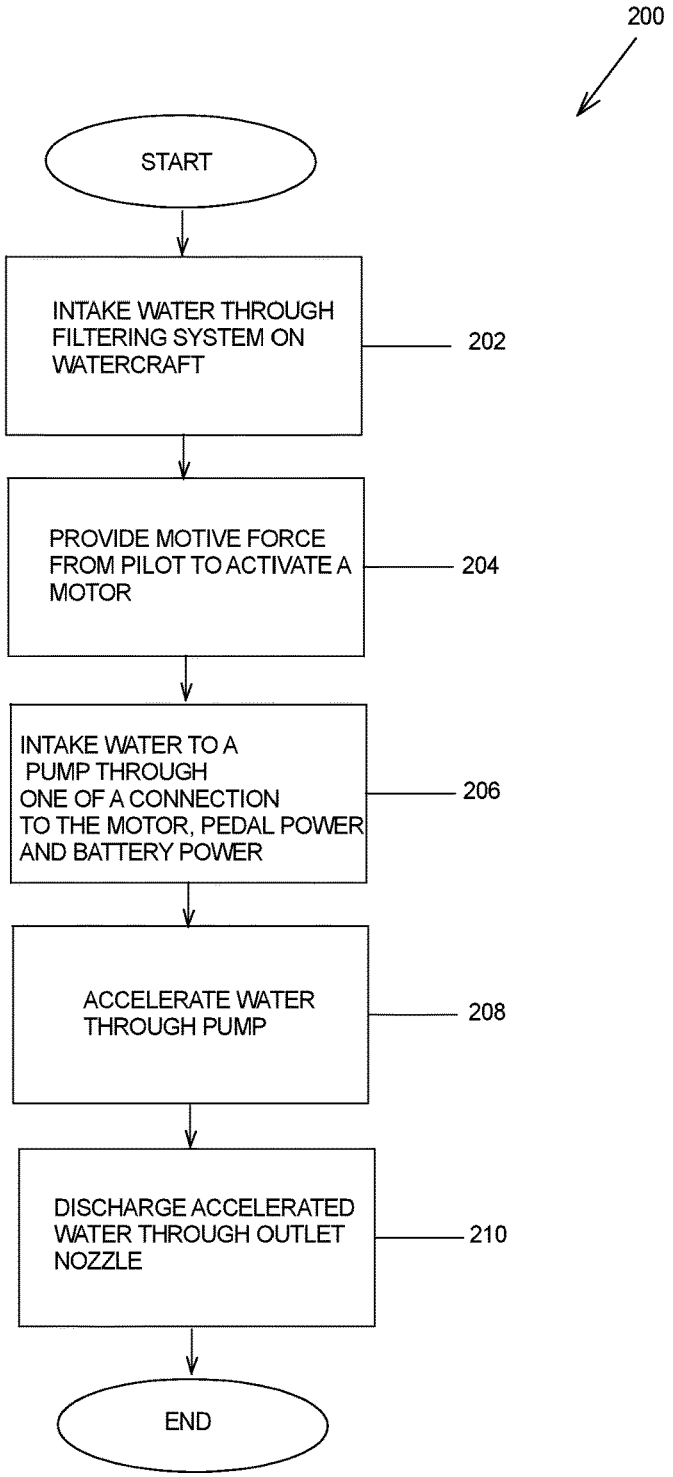
FIG. 2 is a method of operation of a watercraft in in aspect of the disclosure.

Referring to FIG. 2, a method 200 for operating a watercraft is illustrated. At 202, water enters an intake system that has a filtering system for a watercraft. At 204, a motive force is provided by a pilot to activate a pump. The motive force may be, for example, the turning of a crank connected to the pump through a pedal and gear system. The water that passes through the filtering system travels to a pump intake at 206. At 208, the water is accelerated through the pump. At 210, the accelerated water is discharged through an outlet nozzle, thereby propelling the watercraft.

In one example embodiment, a watercraft is disclosed. The watercraft may comprise at least one body. The watercraft may also comprise a seat configured to support a user. The watercraft may also comprise at least one drive mechanism actuated in complete revolutions by the user. The watercraft may also comprise an intake configured to allow a flow of water from a body of water surrounding the watercraft. The watercraft may also comprise a pump configured to receive the flow of water and accelerate the flow of water. The watercraft may also comprise a discharge configured to receive the flow of accelerated water from the pump and discharge the accelerated water to the water surrounding the watercraft.

Other aspects of the disclosure may be used in varying launching configurations. For example, the watercraft may be launched from a beach or from a lake side location due to the bottom surface of the craft being deformable. Deformation allows for the watercraft to enter a waterway without detrimental effects on the bottom of the watercraft from impact. Such a configuration is a market improvement compared to conventional watercraft that use a rigid structure throughout the entire bottom of the watercraft. Thus, the watercraft in aspects of the disclosure may be used in shallow water compared to conventional watercraft that must have a minimum depth of water for movement.

Aspects of the watercraft also provide for a flexibility of the design and for the individuals who will pilot the watercraft. An adjustable seat is provided such that a back angle as well as a forward and back position are provided to allow for varying sizes of the pilot. In embodiments where speed is required, a recumbent position may be provided for the pilot to minimize drag from air resistance, making the watercraft easier to propel through the water. The adjustable seat may also be removed from the watercraft thereby allowing for a weight reduction of the watercraft while moving the watercraft to an embarkation point. Moreover, a removable canopy may be included within the design as well as a sunscreen to protect the pilot from unwanted exposure to the elements.

Aspects of the disclosure also provide for a safety conscious watercraft. In the unwanted occurrence of water being taken into the cabin space of the pilot, a float switch may be provided to allow for the water to be evacuated from the cabin space by the pump. In other embodiments, a hand valve may also be used to provide for a section capability provided by the pump to the water accumulating within the cabin space. As will be understood, the drain allowing for water to be taken from the cabin space may be located at a low point within the cabin space where water is most likely to accumulate.

In another example embodiment, the watercraft may be configured wherein the at least one drive mechanism is a pedal drive configured to be powered by the user.

In another example embodiment, the watercraft may be configured wherein the discharge has an exit nozzle that may be directed by the user, varied in size, and fixed.

In another example embodiment, the watercraft may be configured wherein the discharge points toward the rear of the watercraft.

In another example embodiment, the watercraft may be configured wherein the intake further comprises a filter.

In another example embodiment, the watercraft may be configured wherein the cartridge is a filter.

In another example embodiment, the watercraft may be configured wherein the filter is removable.

In another example embodiment, the watercraft may be configured further comprising a rudder.

In another example embodiment, the watercraft may be configured further comprising a canopy covering at least a part of the user.

In another example embodiment, the watercraft may be configured wherein the canopy is configured to be removable.

In another example embodiment, the watercraft may be configured wherein the discharge is at least one of below a water level, at a stern of the watercraft, along at least one side of the watercraft, passes through at least one side of the hull; passes through the bottom of the hull.

In another example embodiment, the watercraft may be configured wherein the seat is at least one of adjustable, adjustable to a recumbent position and includes a headrest.

In another example embodiment, the watercraft may be configured further comprising a motor connected to the pump.

In another example embodiment, the watercraft may be configured further comprising at least one of solar cells and a battery connected to the motor, wherein the solar cells and the battery are configured to feed an electric current to the motor.

In another example embodiment, the watercraft may be configured wherein the battery is removable from the body.

In another example embodiment, the watercraft may be configured wherein the pump is a reciprocating vane pump, and an unbalanced reciprocating vane pump.

In another example embodiment, the watercraft may be configured wherein the intake is configured of a flexible material.

In another example embodiment, the watercraft may be configured further comprising at least one line connecting the intake to the pump.

In another example embodiment, the watercraft may be configured wherein the intake is placed in a forward direction on one of a leading surface, a side of the watercraft, and a bottom surface of the watercraft.

In another example embodiment, the watercraft may be configured wherein the discharge nozzle is constructed of flexible material.

In another example embodiment, the watercraft may be configured wherein the user is able to brace against the watercraft by at least one of a feature to accept the shaft of a paddle and a set of handles.

In another example embodiment, the watercraft may be configured wherein the drive mechanism comprises pedals, a chain and a sprocket or toothed belt, wherein the chain and the sprocket connect the pump to the pedals.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A watercraft comprising:

at least one body;

a seat configured to support a user;

at least one drive mechanism actuated in complete revolutions by the user, wherein the drive mechanism is a pedal driven sprocket with an associated chain;

an inlet configured to allow a flow of water from a body of water surrounding the watercraft;

a pump configured to receive the flow of water and accelerate the flow of water; and a discharge configured to receive the flow of accelerated water from the pump and discharge the accelerated water to the water surrounding the watercraft, wherein the chain connects the drive mechanism and the pump and wherein the pump is a reciprocating vane pump, wherein at least one vane within the pump is capable of travel through a center axis of a pump rotor.

* * * * *